US008515297B2

(12) United States Patent
Ishikawa

(10) Patent No.: US 8,515,297 B2
(45) Date of Patent: Aug. 20, 2013

(54) SERIAL COMMUNICATION APPARATUS AND IMAGE FORMING APPARATUS INCLUDING THE SAME

(75) Inventor: Junji Ishikawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 13/041,159

(22) Filed: Mar. 4, 2011

(65) Prior Publication Data

US 2011/0223533 A1 Sep. 15, 2011

(30) Foreign Application Priority Data

Mar. 9, 2010 (JP) ..... 2010-052022

(51) Int. Cl.
*G03G 13/20* (2006.01)
*G03G 15/20* (2006.01)

(52) U.S. Cl.
USPC ..... 399/37; 399/88; 399/33

(58) Field of Classification Search
USPC ..... 399/37
See application file for complete search history.

(56) References Cited

U.S. PATENT DOCUMENTS

| | | | | |
|---|---|---|---|---|
| 5,789,723 | A * | 8/1998 | Hirst | 219/501 |
| 5,801,359 | A * | 9/1998 | Mano et al. | 219/667 |
| 6,037,576 | A * | 3/2000 | Okabayashi et al. | 219/619 |
| 2004/0005163 | A1 | 1/2004 | Miura | |
| 2007/0212091 | A1 * | 9/2007 | Kinouchi et al. | 399/69 |
| 2009/0257770 | A1 | 10/2009 | Miyazaki | |

FOREIGN PATENT DOCUMENTS

| | | | |
|---|---|---|---|
| CN | 1652040 | A | 8/2005 |
| JP | 2003-295679 | A | 10/2003 |

* cited by examiner

*Primary Examiner* — Clayton E Laballe
*Assistant Examiner* — Jas Sanghera
(74) *Attorney, Agent, or Firm* — Canon U.S.A., Inc. IP Division

(57) ABSTRACT

An image forming apparatus including a fixing device using an induction heating method determines a driving frequency for a switching element configured to drive an induction coil, according to a difference between a detected temperature of an electrically conductive heating element provided in the fixing device and a target temperature. When the determined frequency is a predetermined minimum frequency and a current flowing through the induction coil is at a predetermined value or less, the image forming apparatus generates a signal indicating the abnormality of electric power supplied to the induction coil.

10 Claims, 7 Drawing Sheets

SERIAL COMMUNICATION APPARATUS AND IMAGE FORMING APPARATUS INCLUDING THE SAME

BACKGROUND OF THE INVENTION

1. Field of the Invention

The present invention relates to an abnormality detection for an electric power source used for a fixing device of the electromagnetic induction heating type.

2. Description of the Related Art

In recent years, as fixing devices of image forming apparatuses, the electromagnetic induction heating type has come into wide use.

The fixing device of the electromagnetic induction heating type includes an electromagnetic induction coil located opposite a fixing roller (belt) composed of magnetic material and electromagnetically coupled thereto, and an electric power source for causing a high-frequency current to flow through the electromagnetic induction coil to produce a high-frequency magnetic field. The high-frequency magnetic field acts on the fixing roller (belt), and eddy current flows through the fixing roller (belt), so that the fixing roller (belt) generates heat. In the fixing device thus configured, a temperature sensor for detecting a temperature of the fixing roller (belt) is provided, and the temperature of the fixing roller (belt) is controlled to a predetermined temperature by controlling the high-frequency current caused to flow through the electromagnetic induction coil based on a detection result by the temperature sensor.

If an abnormality occurs in the power source for the fixing device of the image forming apparatus, a correct high-frequency current may not flow through the coil, and the temperature of the fixing roller (belt) may fall. In this case, the sheet may be output while a toner image remains insufficiently fixed. Thus, when it is detected that the temperature of the fixing roller (belt) has fallen down to equal to or lower than a predetermined temperature which is lower than a lower limit temperature at which the fixing operation is available, an image forming operation is stopped.

However, in this method, since an abnormality can be determined only after falling below the lower limit temperature at which the fixing operation is available, there is a problem that poorly fixed sheets may be output until the abnormality is determined. In particular, with the increasing number of image formed sheets per unit time, the number of poorly fixed sheets may increase.

As measures against the above-described problem, in Japanese Patent Application Laid-Open No. 2003-295679, an image forming apparatus executes abnormality diagnosis of a power source before starting a printing operation. More specifically, the image forming apparatus once turns off the power source of the fixing device before starting the printing operation, and again turns on the power source. Then, the image forming apparatus checks detected current values Is of currents flowing through the power source before turning on and after turning on the power source, respectively. If $Is>0$ before turning on the power source or $Is\leqq 0$ after turning on the power source, the printing operation is inhibited as it is determined that abnormality is occurring in the power source. If $Is\leqq 0$ before turning on the power source and $Is>0$ after turning on the power source, the printing operation is started as it is determined that the power source is normal. In this way, in Japanese Patent Application Laid-Open No. 2003-295679, since abnormality diagnosis is performed before the printing operation is started, the printing operation is started after it has been confirmed that the power source is normal.

In a diagnosis method discussed in Japanese Patent Application Laid-Open No. 2003-295679, diagnosis before the printing operation is started is executable. However, since the image forming apparatus usually performs temperature control of the fixing device during the printing operation, the detected current value Is varies according to the temperature of the fixing device. For this reason, it is difficult to discriminate whether a current is not flowing in the process of the temperature control or a current is not flowing due to abnormality of the power source. If the power source is forcibly turned off during the printing operation for the purpose of diagnosis, the temperature of the fixing device may fall, and poorly fixed sheets may be output, in a case where a temperature immediately before turning off is close to the lower limit temperature at which the fixing operation is available. Moreover, in order to diagnose abnormality of the power source during temperature control, it is necessary to provide a sequence for diagnosis in a program of the temperature control. For this reason, in a diagnosis method discussed in Japanese Patent Application Laid-Open No. 2003-295679, it is difficult to determine an abnormality of the power source occurring during the progress of the printing operation.

SUMMARY OF THE INVENTION

According to an aspect of the present invention, an apparatus including a fixing device configured to fix a toner image transferred onto a sheet by causing a heating element to generate heat through an induction heating method includes an induction coil configured to generate a magnetic field for induction heating, a resonant capacitor connected to the induction coil, a switching element configured to supply electric power to the induction coil, a driving circuit configured to generate a driving signal for driving the switching element, a temperature detection unit configured to detect a temperature of the heating element, a driving signal generation circuit configured to determine a frequency of the driving signal which becomes equal to or higher than a set minimum frequency, according to a difference between the detected temperature and a target temperature of the fixing device, and to generate the determined driving signal, a current detection unit configured to detect a current corresponding to the supplied electric power, and a determination unit configured to, if the frequency of the driving signal is the minimum frequency and the detected current is equal to or less than a predetermined value, generate a signal representing abnormality of the supplied electric power.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
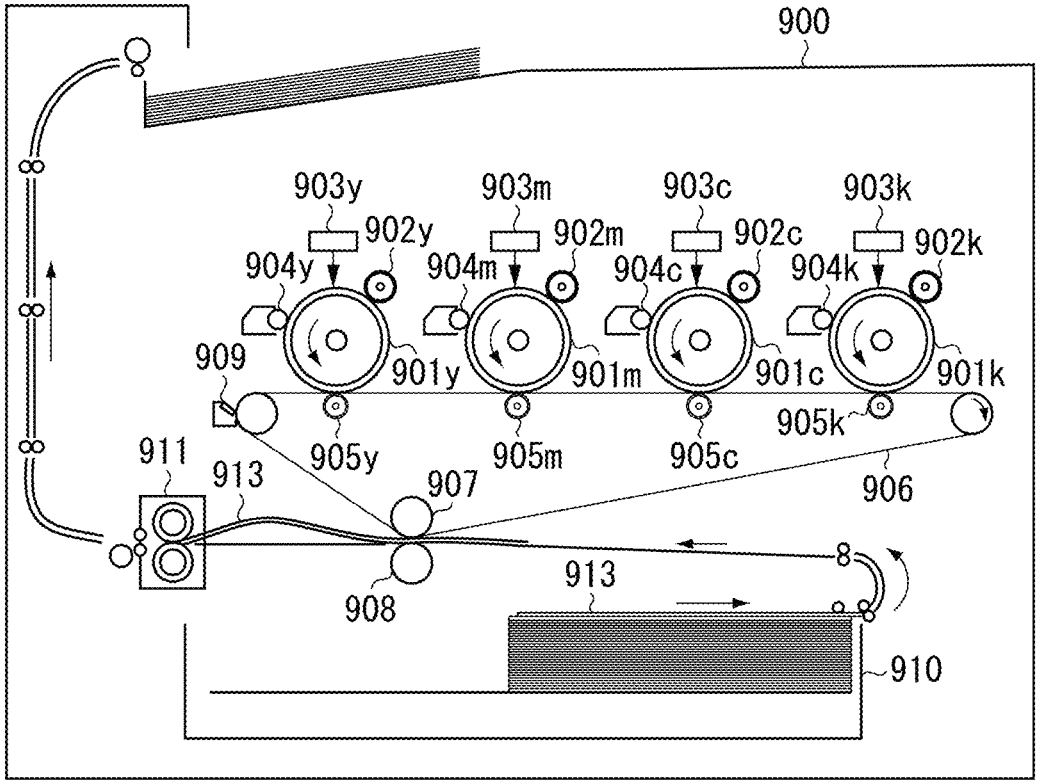
FIG. 1 illustrates a schematic configuration of an image forming apparatus according to a first exemplary embodiment of the present invention.

FIG. 1 is a schematic configuration diagram of an image forming apparatus according to a first exemplary embodiment of the present invention. An image forming apparatus 900 includes image forming units for yellow (y), magenta (m), cyan (c), and black (k). The image forming unit for yellow will be described. A photosensitive drum 901*y* rotates in a counterclockwise direction, and a primary charging roller 902*y* uniformly charges a surface of the photosensitive drum 901*y*. The uniformly charged surface of the photosensitive member 901*y* is irradiated with a laser from a laser unit 903*y*, and a latent image is formed on the surface of the photosensitive member 901*y*. The formed electrostatic latent image is developed with yellow toner by a development device 904*y*. Then, the yellow toner image developed on the photosensitive member 901*y* is transferred onto the surface of an intermediate transfer belt 906 by a voltage being applied to a primary transfer roller 905*y*.

In a similar manner, toner images of magenta, cyan, and black are transferred onto the surface of the intermediate transfer belt 906. A full-color toner image formed of yellow, magenta, cyan, and black toners is thus formed on the intermediate transfer belt 906. Then, the full-color toner image formed on the intermediate transfer belt 906 is transferred onto a sheet 913 fed from a cassette 910 at a nip portion between secondary transfer rollers 907 and 908. The sheet 913, which has passed through the secondary transfer rollers 907 and 908, is conveyed to the fixing device 911, where it is heated and pressed, so that the full-color image is fixed on the sheet 913.

Figure 2:
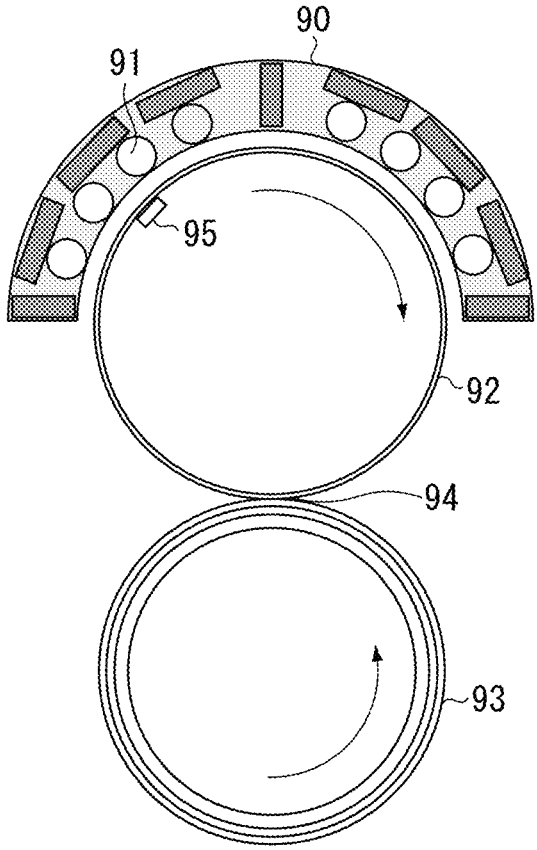
FIG. 2 illustrates the details of a fixing device according to the first exemplary embodiment of the present invention.

FIG. 2 is a cross-sectional view illustrating a schematic configuration of the fixing device 911 using the electromagnetic induction heating process. A fixing roller (belt) 92 is composed of an electrically conductive heating element made of a metal with a thickness of 45 μm, and its surface is covered by a 300 μm rubber layer. Rotation of a driving roller 93 is transmitted from a nip portion 94 to the fixing roller (belt) 92, so that the fixing roller (belt) 92 rotates in the direction of an arrow. An electromagnetic induction coil 91 is disposed within a coil holder 90 to be opposite the fixing roller (belt) 92, and a power source (not illustrated) causes an AC current to flow through the electromagnetic induction coil 91 to produce magnetic field, so that the electrically conductive heating element of the fixing roller (belt) 92 generates heat by itself. A thermistor 95 as a temperature detection unit abuts against a heating portion of the fixing roller (belt) 92 from its inner side, and detects the temperature of the fixing roller (belt) 92.

Figure 3:
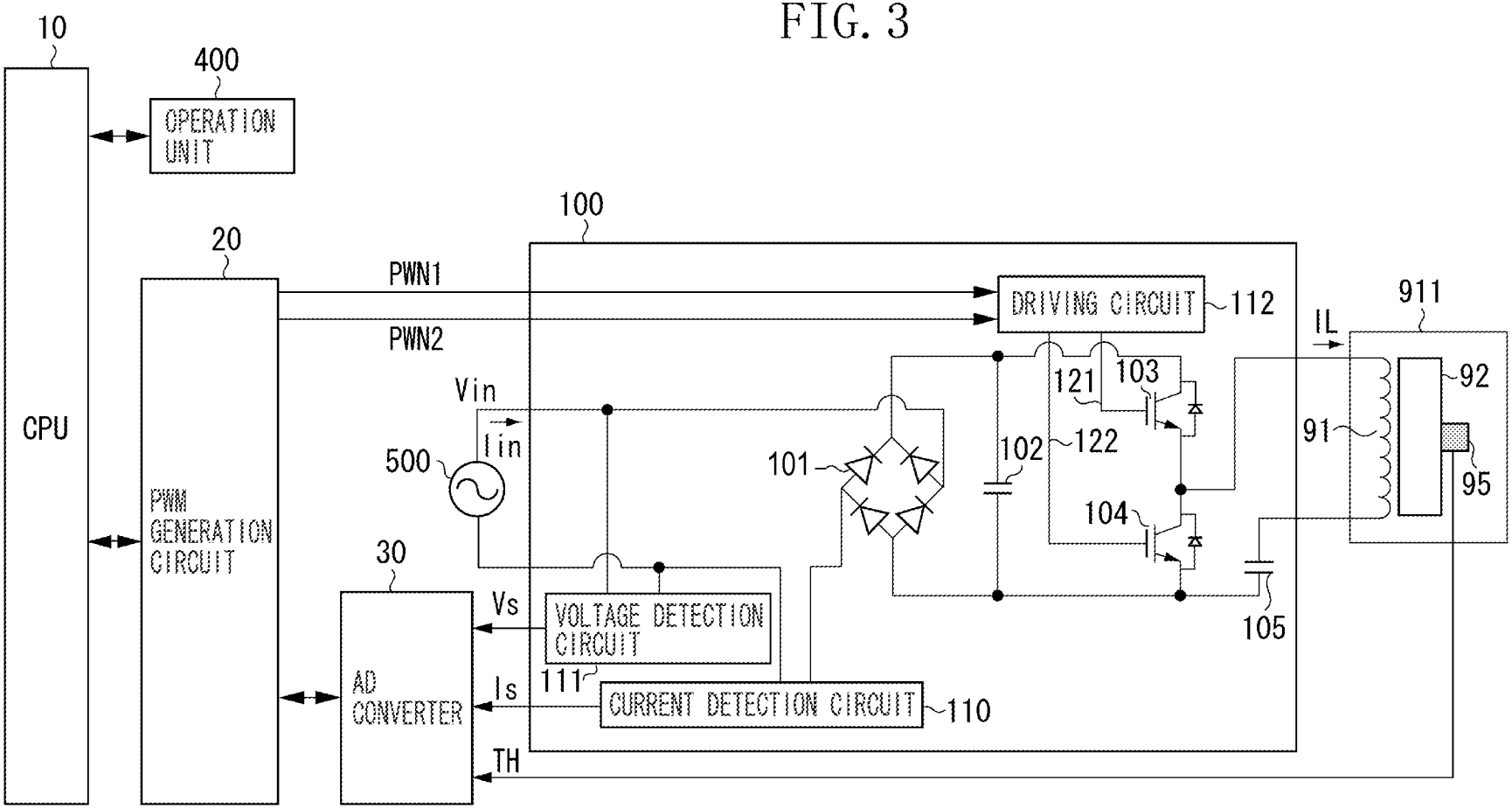
FIG. 3 illustrates a circuit diagram for fixing control according to the first exemplary embodiment of the present invention.

FIG. 3 illustrates a temperature control circuit of the fixing device using the electromagnetic induction heating process in the first exemplary embodiment.

A power source 100 includes a diode bridge 101, a smoothing capacitor 102, and first and second switching elements 103 and 104. The power source 100 rectifies and smoothes an AC current from an AC commercial power source 500, and supplies it to the switching elements 103 and 104. The power source 100 further includes a resonant capacitor 105 that forms a resonant circuit in conjunction with the electromagnetic induction coil 91, and a driving circuit 112 that outputs driving signals for the switching elements 103 and 104.

The power source 100 further includes a current detection circuit 110 that detects an input current Iin, and a voltage detection circuit 111 that detects an input voltage Vin. The input current Iin and the input voltage Vin take values corresponding to the electric power supplied to the electromagnetic induction coil 91.

The CPU 10 performs overall control of the image forming apparatus 900, and sets a target temperature To of the fixing roller (belt) 92 within the fixing device 911 and a maximum pulse width (upper limit value) ton(max) of the PWM signals corresponding to the driving frequency of the switching elements 103 and 104 for the PWM generation circuit 20. The maximum pulse width ton(max) of the PWM signals is set so as not to exceed a pulse width corresponding to a minimum frequency matched to a resonant frequency.

The minimum frequency can be a resonant frequency, but becomes a frequency slightly higher than the resonant frequency, in anticipation of safety, so that the frequency of the driving signals described below may not fall below the resonant frequency. The CPU 10 further sets a minimum pulse width ton(min) at which the switching elements 103 and 104 can perform a switching operation and a maximum electric power to be used in the fixing device 911 for the PWM generation circuit 20. This minimum pulse width becomes a pulse width corresponding to 100 kHz with reference to the Radio Law.

The PWM generation circuit 20 inputs a detected value TH of a surface temperature of the fixing roller (belt) 92 detected using the thermistor 95, a detected current value Is of the current detection circuit 110, and a detected value Vs of the voltage detection circuit 111 via an AD converter 30. Then, the PWM generation circuit 20 determines signals PWM1 and PWM2 corresponding to pulse widths (frequencies) of the driving signals 121 and 122 which the driving circuit 112 outputs based on a difference between the detected value TH and the target value.

The driving circuit 112 performs level conversion of the signals PWM1 and PWM2 into the driving signals 121 and 122. In other words, the PWM generation circuit 20 and the driving circuit 112 act as a driving signal generation unit. The switching elements 103 and 104 are alternately switched ON/OFF in accordance with the driving signals 121 and 122, and supply a high-frequency current IL to the electromagnetic induction coil 91.

On-width and off-width of pulses of the driving signals 121 and 122 are equal to each other, and on-width of pulse of the driving signal 121 and on-width of pulse of the driving signal 122 are also set equal to each other, which yields a duty ratio of 50%. Therefore, as the on-width of pulse is widened, the off-width is also widened by the same amount, and thus a frequency of the driving signal becomes low.

An operation unit 400 has an indicator that performs display of key or information for receiving instructions from an operator.

Figure 4:
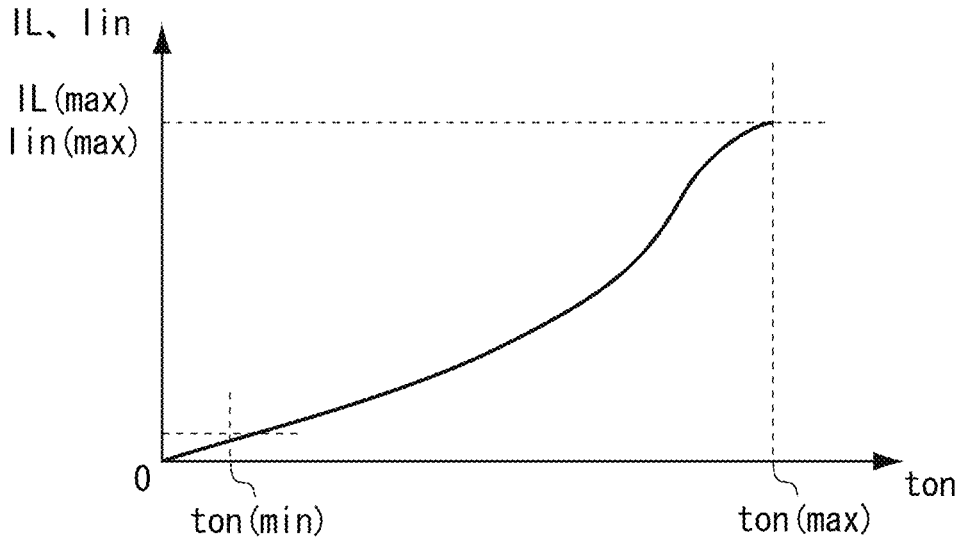
FIG. 4 illustrates a relationship between the pulse width of a pulse width modulation (PWM) signal and an electric current.

FIG. 4 illustrates a relationship between a pulse width of the PWM signal and an input current Iin or a high-frequency current IL that flows through the electromagnetic induction coil 91. The input current Iin is increased as the pulse width is widened, and is decreased as the pulse width is narrowed, in a range of pulse widths narrower than a maximum pulse width of the driving signals 121 and 122.

This maximum pulse width is a pulse width corresponding to the minimum frequency matched to the resonant frequency which is determined from inductance values of the electromagnetic induction coil 91 and the fixing roller (belt) 92 and a capacitance value of the resonant capacitor 105. In other words, in a frequency equal to or higher than the minimum frequency, the input current Iin is increased as the frequency of the driving signal becomes low, and the input current Iin is decreased as the frequency becomes high.

The high-frequency current IL which flows through the electromagnetic induction coil 91 is also similar to the input current Iin. Increase or decrease of the high-frequency current IL is directly proportional to the strength of the generated magnetic field, and the heating value of the electrically conductive heating element also increases or decreases as the high-frequency current IL increases or decreases. Accordingly, the PWM generation circuit 20 can control the temperature of the fixing roller (belt) 92 by adjusting the frequency (pulse width) of the high-frequency current IL.

Figure 5:
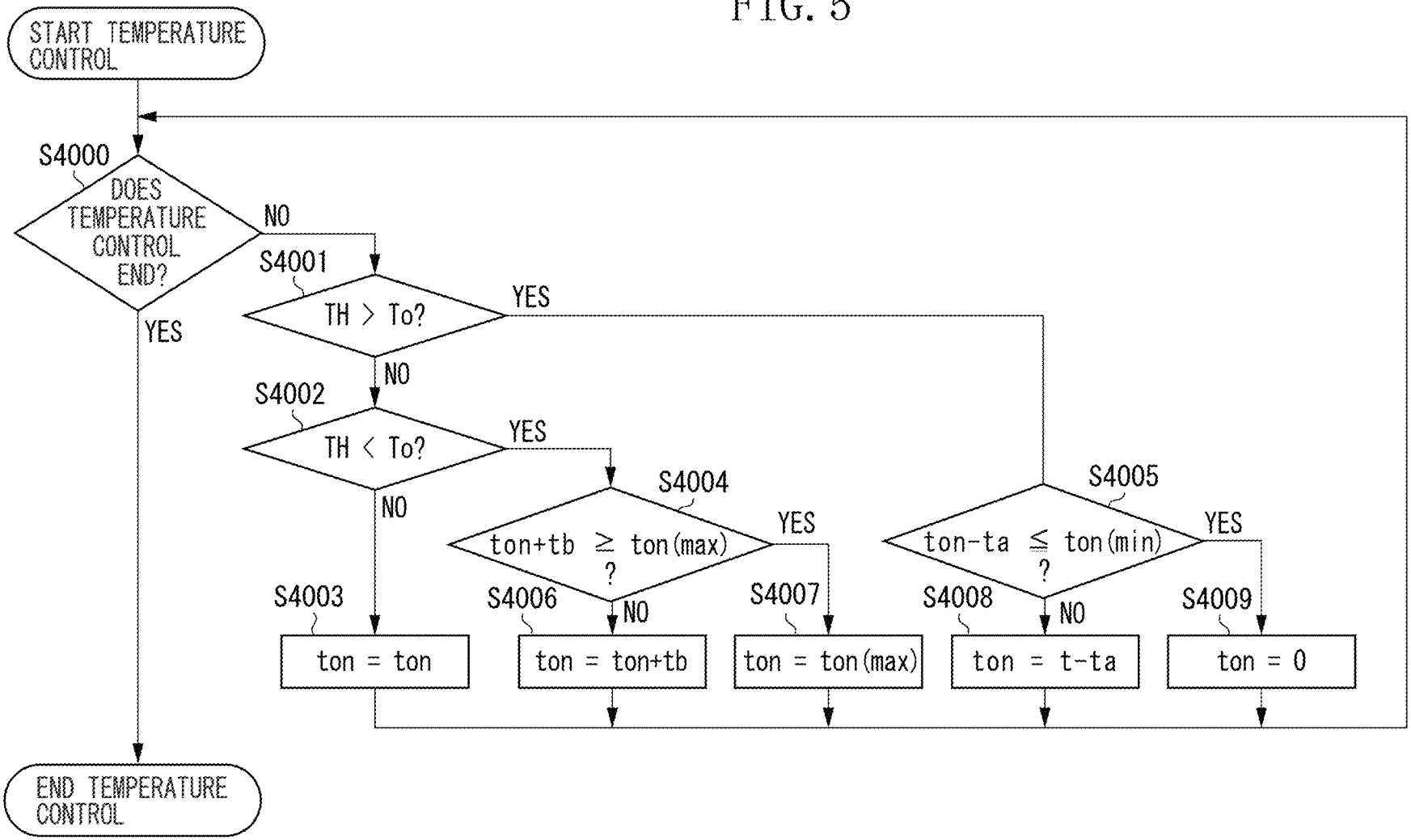
FIG. 5 is a flowchart illustrating temperature control according to the first exemplary embodiment.

A simple control method in the PWM generation circuit 20 at the time of temperature control of the fixing roller (belt) 92 will be described with reference to the flowchart in FIG. 5.

In steps S4001 and S4002, the PWM generation circuit 20, upon receiving a command of temperature control start from the CPU 10, compares a detected temperature TH with a target temperature To (e.g., 180° C.).

If TH>To (YES in step S4001), then in step S4005, the PWM generation circuit 20 determines whether a value obtained by decreasing a pulse width of a PWM signal by a predetermined value ta becomes equal to or less than a minimum pulse width ton(min). If the value does not become equal to or less than the minimum pulse width (NO in step S4005), then in step S4008, the PWM generation circuit 20 narrows the pulse width by the predetermined value ta. On the other hand, if the value obtained after decreasing becomes equal to or less than the minimum pulse width (YES in step S4005), then in step S4009, the PWM generation circuit 20 sets the pulse width of the PWM signal to 0, and temporarily stops driving of the switching elements 103 and 104 (intermittent driving).

If TH<To (YES in step S4002), then in step S4004, the PWM generation circuit 20 determines whether a value obtained by increasing the pulse width of the PWM signal by a predetermined value tb exceeds a maximum pulse width ton(max). If the maximum pulse width is not exceeded (NO in step S4004), then in step S4006, the PWM generation circuit 20 widens the pulse width of the PWM signal by the predetermined value tb. On the other hand, a value obtained after increasing exceeds the maximum pulse width (YES in step S4004), then in step S4007, the PWM generation circuit 20 sets the pulse width of the PWM signal to the maximum pulse width ton (max).

If TH=To (NO in steps S4001 and S4002), then in step S4003, the PWM generation circuit 20 maintains the pulse width. The PWM generation circuit 20 continues the above-described control until the end of the temperature control.

In the above-described control, when abnormality occurs in the power source 100, and the high-frequency current IL becomes unable to be supplied to the electromagnetic induction coil 91, induction heating becomes unable to be performed, and a detected temperature TH becomes lower than the target temperature To. Therefore, the PWM generation circuit 20 operates to increase the high-frequency current IL so as to increase the temperature of the fixing device. As a result, the PWM generation circuit 20 operates in a state where the pulse width of the PWM signals (PWM1, PWM2) output from the PWM generation circuit 20 always stays at ton (max).

Figure 6:
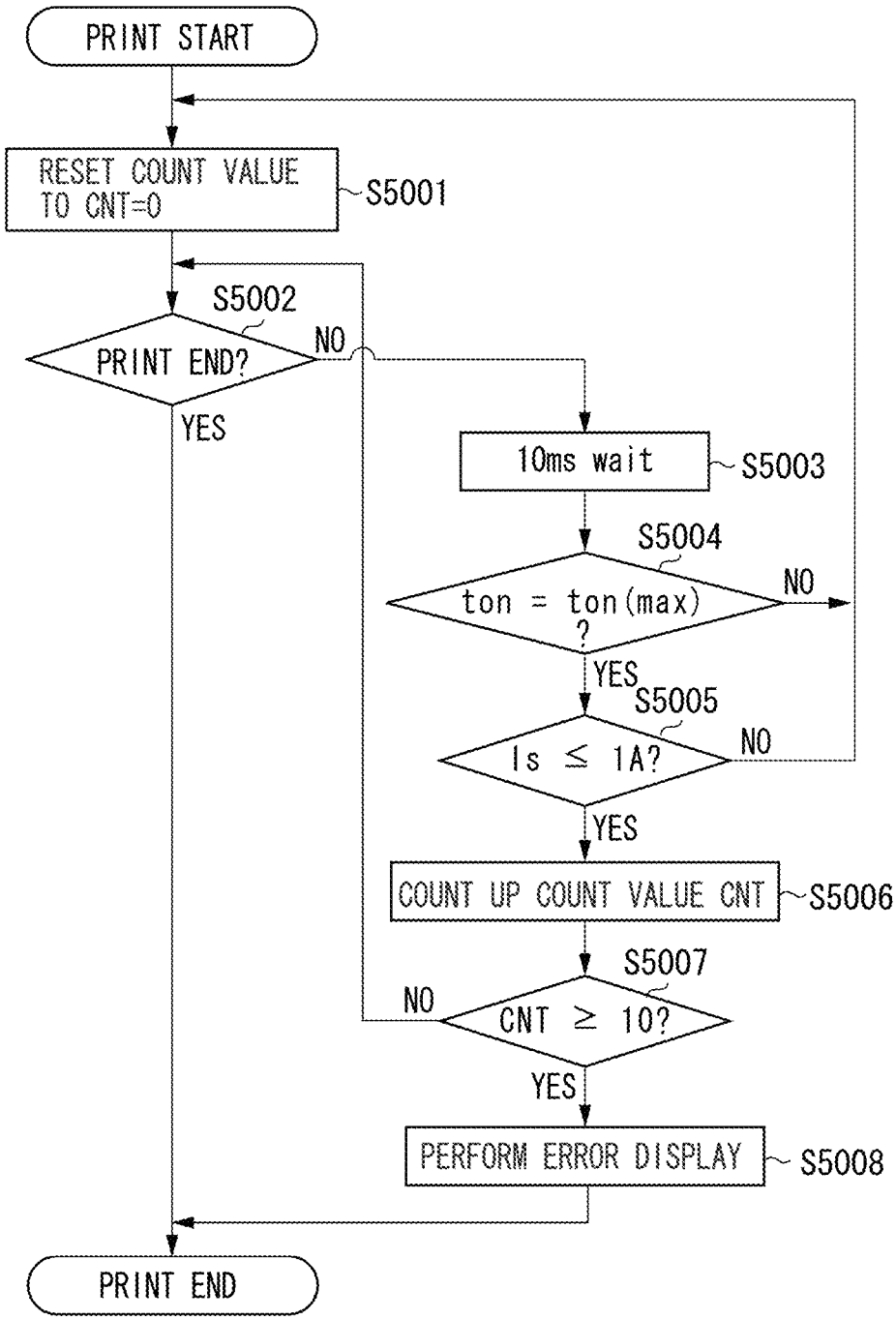
FIG. 6 is a flowchart illustrating power source abnormality determination during the progress of a printing operation according to the first exemplary embodiment.

Next, a method for determining power source abnormality during the progress of a printing operation will be described with reference to the flowchart in FIG. 6. This abnormality determination is executed by the CPU 10.

When the CPU 10 starts the printing operation, then in step S5001, the CPU 10 resets a count value CNT for abnormality state determination. Thereafter, if the printing operation has not ended (NO in step S5002), then in step S5003, the CPU 10 waits for 10 ms, and acquires information of the pulse width ton of the PWM signals at this time point from the PWM generation circuit 20. Then, in step S5004, the CPU 10 determines whether the acquired pulse width ton is equal to the maximum pulse width ton (max).

If the both are equal to each other (YES in step S5004), then in step S5005, the CPU 10 acquires a detected current value Is, and determines whether the detected value Is is equal to or less than a predetermined value (equal to or less than 1 A). If Is≦1 A (YES in step S5005), then in step S5006, the CPU 10 counts up the count value CNT. Then, in step S5007, the CPU 10 determines whether the count value CNT is equal to or greater than 10.

If CNT≧10 (YES in step S5007), that is, if a state of Is≦1 A continues for a predetermined time, then in step S5008, the CPU 10 generates a signal representing an abnormality to perform error display on the operation unit 400, and stops the printing operation. In other words, the CPU 10 acts as an abnormality determination unit.

On the other hand, if ton≠ton (max) (NO in step S5004), or if Is>1 A (NO in step S5005), the CPU 10 returns to step S5001 to reset the count value CNT, and repeats processing until the printing operation is completed. On the other hand, if the count value CNT is less than 10 (NO in step S5007), the CPU 10, without resetting the count value CNT, repeats processing until the printing operation is completed.

During temperature control, the pulse width of the PWM signal varies between the minimum pulse width ton (min) and the maximum pulse width ton (max) according to the temperature of the fixing device at this time. If the power source 100 normally operates, the detected current value Is is increased as the pulse width of the PWM signal is widened from the minimum pulse width ton (min) to the maximum pulse width ton (max). Even if the pulse width of the PWM signal temporarily stays at the maximum pulse width, when the temperature of the fixing device is lower than the target temperature, the detected current value Is at this time becomes equal to or greater than 1 A, and never becomes 0.

On the other hand, in a case where the power source 100 is abnormally stopped, the power source 100 goes into a state in which the detected current value Is is 0, although the pulse width of the PWM signal is widened to the maximum pulse width ton (max).

In this way, abnormality of the power source 100 is determined based on the detected current value Is in a state in which the pulse width of the PWM signal stays at the maximum pulse width. As a result, abnormality can be surely determined in a short time (100 ms in the present exemplary embodiment), without depending on a target temperature of the fixing device.

The power source abnormality can be thus determined in a short time, so that a drop in fixing temperature can be predicted earlier than the detection of fall in temperature by the thermistor 95. As a result, the printing operation can be stopped before poorly fixed sheets are output in a large number.

In the present exemplary embodiment, an example in which determination is made based on the detected value Is of the input current Iin when abnormality of the power source 100 is determined, has been described. Although similar effects can be obtained even when an input power is calculated from the detected value Is of the input current Iin and the detected value Vs of the input voltage Vin, and determination is made based on the input power.

Further, determination of power source abnormality in the present exemplary embodiment, although it has been described taking a printing operation in progress as an example, is effective even at a time other than the printing operation if temperature control is in progress.

In the above-described first exemplary embodiment, the image forming apparatus detects the input voltage Vin and the input power Iin. In a second exemplary embodiment of the present invention, the image forming apparatus detects a voltage VL and a current IL of the electromagnetic induction coil 91 to detect abnormality of the power source 100. The voltage VL and the current IL become values matched to electric power supplied to the electromagnetic induction coil 91.

Figure 7:
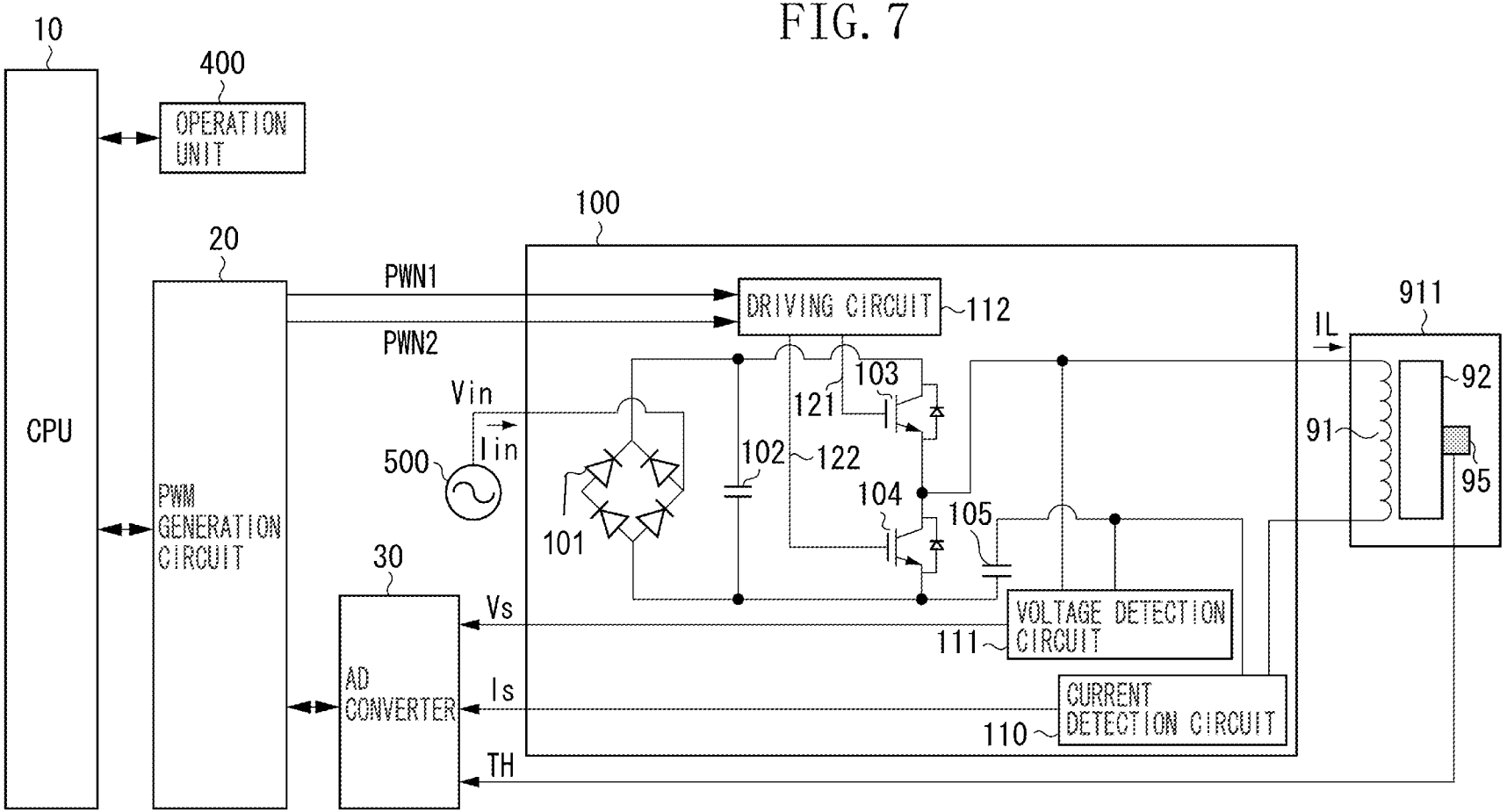
FIG. 7 illustrates a circuit diagram for fixing control according to a second exemplary embodiment of the present invention.

FIG. 7 illustrates a temperature control circuit in the second exemplary embodiment. Positions of the current detection circuit 110 and the voltage detection circuit 111 are different from those in the circuit in FIG. 3, and the current detection circuit 110 detects the high-frequency current IL flowing through the electromagnetic induction coil 91, and the voltage detection circuit 111 detects a voltage applied across the electromagnetic induction coil 91. Similar to the first exemplary embodiment, the output Is of the current detection circuit 110 and the output Vs of the voltage detection circuit 111 are input into the PWM generation circuit 20 via the AD converter 30. Temperature control by the PWM generation circuit 20 is similar to that in the first exemplary embodiment. Moreover, a determination method for abnormality of the power source 100 is also similar to the processing of the flowchart in FIG. 6, provided that only targets of current and voltage to be detected are different.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-052022 filed Mar. 9, 2010, which is hereby incorporated by reference herein in its entirety.

What is claimed is:

1. An apparatus including a fixing device configured to fix a toner image transferred onto a sheet by causing a heating element to generate heat using an induction heating method, the apparatus comprising:

an induction coil configured to generate a magnetic field for induction heating; and a power source circuit configured to supply a high-frequency current to the induction coil, the power source circuit comprising:

a resonant capacitor connected to the induction coil;

a switching element configured to supply electric power to the induction coil;

a driving circuit configured to generate a driving signal for driving the switching element;

a temperature detection unit configured to detect a temperature of the heating element; and a current detection unit configured to detect a current corresponding to the supplied electric power;

a driving signal generation circuit configured to determine a frequency of the driving signal which becomes equal to or higher than a set minimum frequency, according to a difference between the detected temperature and a target temperature of the fixing device, and to generate the determined driving signal, the electric power supplied to the induction coil being increased as the frequency of the driving signal is closer to the minimum frequency;

and a determination unit configured to, if the frequency of the driving signal is the minimum frequency and the detected current is equal to or less than a predetermined value, generate a signal representing abnormality of the power source circuit.

2. The apparatus according to claim 1, further comprising a control unit configured to stop formation of the toner image onto the sheet when the signal representing abnormality is generated.

3. The apparatus according to claim 1, wherein the minimum frequency is set at a frequency higher than a resonant frequency of the induction coil.

4. The apparatus according to claim 1, wherein the determination unit is configured to generate the signal representing abnormality in response to a state continuing for a predetermined time in which the determined frequency of the driving signal is the minimum frequency and the detected current is equal to or less than the predetermined value.

5. The apparatus according to claim 1, wherein the driving signal generation circuit is configured to, if the detected temperature is lower than the target temperature, decrease the frequency of the driving signal, and if higher than the target temperature, increase the frequency of the driving signal.

6. The apparatus according to claim 1, wherein the current detection unit is configured to detect an input current to the switching element or the input current flowing through the induction coil.

7. An apparatus including a fixing device configured to fix a toner image transferred onto a sheet by causing a heating element to generate heat using an induction heating method, the apparatus comprising:

an induction coil configured to generate a magnetic field for induction heating;

a resonant capacitor connected to the induction coil;

a switching element configured to supply electric power to the induction coil;

a driving circuit configured to generate a driving signal for driving the switching element;

a temperature detection unit configured to detect a temperature of the heating element;

a current detection unit configured to detect a current corresponding to the supplied electric power;

a driving signal generation circuit configured to determine a frequency of the driving signal which becomes equal to or higher than a set minimum frequency, according to a difference between the detected temperature and a target temperature of the fixing device, and to generate the determined driving signal, the electric power supplied to the induction coil being increased as the frequency of the driving signal is closer to the minimum frequency; and a control unit configured to, in a case where the frequency of the driving signal continues to be the minimum frequency and the detected current continues to be equal to or less than a predetermined value for a predetermined time period during an image forming operation, stop the image forming operation.

8. The apparatus according to claim 7, wherein the minimum frequency is set at a frequency higher than a resonant frequency of the induction coil.

9. The apparatus according to claim 7, wherein the driving signal generation circuit is configured to, if the detected temperature is lower than the target temperature, decrease the frequency of the driving signal, and if higher than the target temperature, increase the frequency of the driving signal.

10. The apparatus according to claim 7, wherein the current detection unit is configured to detect an input current to the switching element or the input current flowing through the induction coil.

* * * * *